US005628287A

United States Patent [19]

Brackett et al.

[11] Patent Number: 5,628,287

[45] Date of Patent: May 13, 1997

[54] ADJUSTABLE CONFIGURATION NOISE ATTENUATION DEVICE FOR AN AIR INDUCTION SYSTEM

[75] Inventors: Stephen E. Brackett, Blenheim; David C. Doddy, Charing Cross, both of Canada

[73] Assignee: Siemens Electric Limited, Chatham, Canada

[21] Appl. No.: 315,459

[22] Filed: Sep. 30, 1994

[51] Int. Cl.[6] ..... F02B 75/18

[52] U.S. Cl. ..... 123/184.55; 123/184.57

[58] Field of Search ..... 123/184.53, 184.55, 123/184.57

[56] References Cited

U.S. PATENT DOCUMENTS

| | | | |
|---|---|---|---|
| 4,759,320 | 7/1988 | Fujii et al. | 123/184.55 |
| 4,934,343 | 6/1990 | Lee . | |
| 4,936,413 | 6/1990 | Lee . | |
| 5,092,284 | 3/1992 | Yamada | 123/184.55 |
| 5,092,285 | 3/1992 | Beaber | 123/184.55 |
| 5,377,629 | 1/1995 | Brackett et al. . | |
| 5,424,494 | 6/1995 | Houle et al. . | |

FOREIGN PATENT DOCUMENTS

| | | | |
|---|---|---|---|
| 3109229 | 5/1988 | Japan | 123/184.53 |

*Primary Examiner*—Marguerite McMahon
*Attorney, Agent, or Firm*—Russel C. Wells

[57] ABSTRACT

A noise attenuating device is disclosed combined with the air induction system of a multicylinder internal combustion piston engine, which includes an expansion chamber connected into the air induction system with an inlet and outlet. A first and a second tuning tube is concentric with the inlet and outlet, respectively, and are axially movable relative each other to assume either an underlapped or an overlapped configuration. The tubes are relatively driven axially to be shifted between the overlapped configuration at low engine speeds (under 2500 rpm) and an underlapped configuration at higher engine speeds to more effectively attenuate the characteristic harmonic orders of induction noise at these respective engine speed ranges.

19 Claims, 2 Drawing Sheets

ADJUSTABLE CONFIGURATION NOISE ATTENUATION DEVICE FOR AN AIR INDUCTION SYSTEM

FIELD OF THE INVENTION

This invention concerns noise attenuation in air induction systems for multicylinder internal combustion piston engines.

BACKGROUND OF THE INVENTION

Noise attenuation devices have heretofore been developed for the air induction systems of internal combustion engines.

One device used in such systems comprises an expansion chamber connected in the air intake flow path via an inlet and an outlet, the expansion chamber preventing the formation of large standing waves and absorbing acoustic energy. A venturi is sometimes formed in the inlet and/or the outlet to enhance performance of the expansion chamber and minimize the restrictive effect of the device on intake air flow.

See U.S. Pat. No. 5,163,387 issued on Nov. 17, 1992 for a "Device for Attenuating Standing Waves in an Induction Intake System" for an example of such a device.

The inlet and outlet include tube ends projecting in opposite directions into the expansion chamber, and these ends can have either an "overlapped" or "underlapped" relationship. When overlapped, the tube ends within the chamber extend past each other in the expansion chamber. In the underlapped condition, the tube ends within the chamber are separated from each other by a predetermined distance.

The noise in the air intake systems is composed of various harmonic orders, and which orders predominate depends on the rotational speed at which the piston engine is being operated, i.e., at higher speeds, the higher order harmonics of induction noise predominate, while at lower engine speeds, the lower order harmonics predominate.

It has been found that an underlapped or overlapped relationship of the inlet and outlet tubes has a basic effect on the noise attenuation function, i.e., the overlapped inlet and outlet tube configuration is effective in attenuating the fundamental and second orders of induction noise, while the underlapped configuration is effective in attenuating higher order harmonics.

Thus, if the overlapped configuration is used, the attenuation is less effective at higher engine speeds and, if the underlapped configuration is utilized, the device is less effective at lower engine speeds.

Accordingly, it is an object of the present invention to provide a resonator device of this type with improved effectiveness over a wide range of engine speeds.

SUMMARY OF THE INVENTION

This object and others which will become apparent upon a reading of the following specification and claims, are achieved by combining an air induction system for a multicylinder internal combustion piston engine with an adjustable configuration expansion chamber device. The expansion chamber has an opposing inlet and outlet, each fitted with a tuning tube, which tuning tubes are relatively shiftable by one or more actuators. The tubing tubes are positioned during engine operation to have either an overlapped or underlapped configuration depending on the sensed engine speed range. During lower speeds, the inlet and outlet tuning tubes are maintained in an overlapped relationship, and are driven to have an underlapped configuration in response to development of higher engine speeds. At midrange engine speeds, a slight overlapped condition is established.

Either one or both tuning tubes are driven axially as by an electrical stepper motor or an electronically controlled vacuum motor actuator to be alternatively configured to be overlapped or underlapped as described.

The tuning tubes can be aligned to be telescoped together when overlapped, or can be offset and their ends moved past each other when overlapped.

The movable tuning tubes are advantageously keyed to the associated inlet or outlet pipe to be guided when being axially driven by the associated actuator.

DETAILED DESCRIPTION

Figure 1:
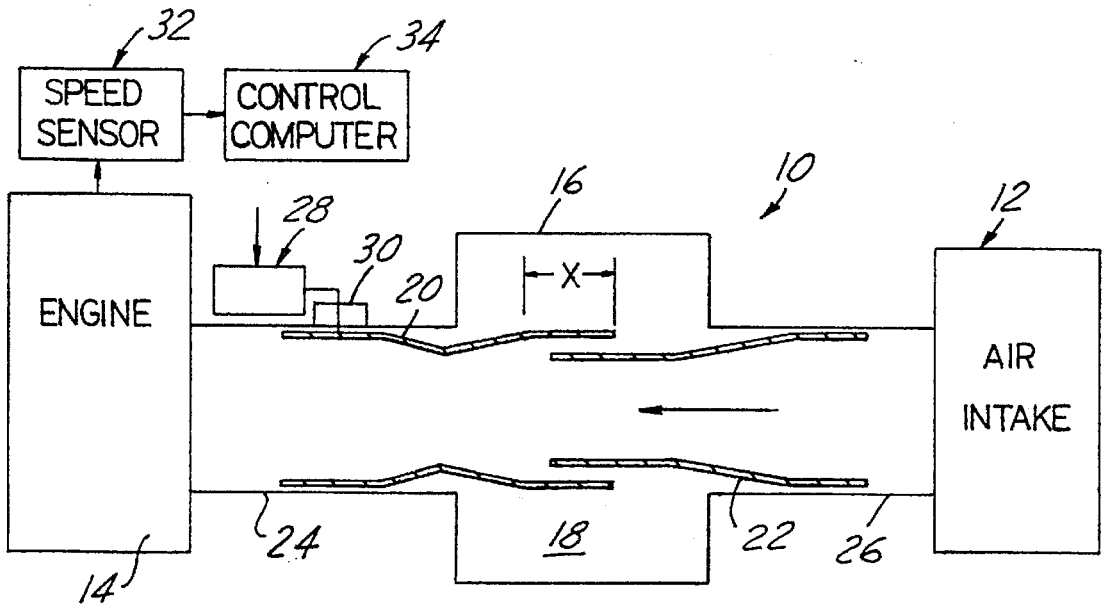
FIG. 1 is a diagrammatic representation of a noise attenuation device according to a first embodiment of the invention.

Referring to the drawings and particularly FIG. 1, a noise attenuation device 10 according to the invention is shown installed in the air induction system 12 of a multicylinder internal combustion piston engine 14. The noise attenuation device 10 includes a resonator housing 16 defining a resonator or expansion chamber 18.

A pair of oppositely directed tuning tubes 20, 22 are capable of being telescoped together at their respective ends projecting into the expansion chamber 18. The tuning tube 20 is axially slidable in the outlet 24 leading to the engine 14, while the other tuning tube 22 is nested within the inlet 26, although axially fixed.

An actuator motor 28 is drivingly connected to axially movable tuning tube 20 by means of a drive linkage system 30 so that when the motor 28 is activated, movable tuning tube 20 is driven axially either towards or away from the telescoped fixed tuning tube 22. A suitable sealing arrangement is required where elements of linkage system 30 pass through the outlet wall.

An engine speed sensor 32 generates a signal corresponding to the rotational speed of the operation of the engine 14, which is transmitted to a control computer 34. Control computer 34 causes the motor 28 to be activated so as to enable the tube 20 to be driven axially through a range of motion "X". An overlap configuration is initially established, but the tuning tube configuration is shifted to an underlap condition when engine speed exceeds a predetermined level, i.e., for example, 2500 rpm, by driving tuning tube 20 away from tuning tube 22.

Tube 20 is driven towards tube 22 when the sensed engine speed again declines under 2500 rpm, reestablishing an overlap configuration of tuning tubes 20, 22.

The relative adjustment may be incrementally conducted, i.e., with incremental changes in engine speeds, incremental advancement or retraction of tube 20 occurs towards or away from the underlap condition. This affords a continuum of tuning effect and reduces the extent of motion required for any given adjustment step. Thus, at midrange speeds, a slight overlap will result, while at low range speeds, a more pronounced overlap will be established.

Effective noise attenuation over the entire range of engine speeds is achieved by virtue of this dual configuration of the attenuation device 10.

Figure 2:
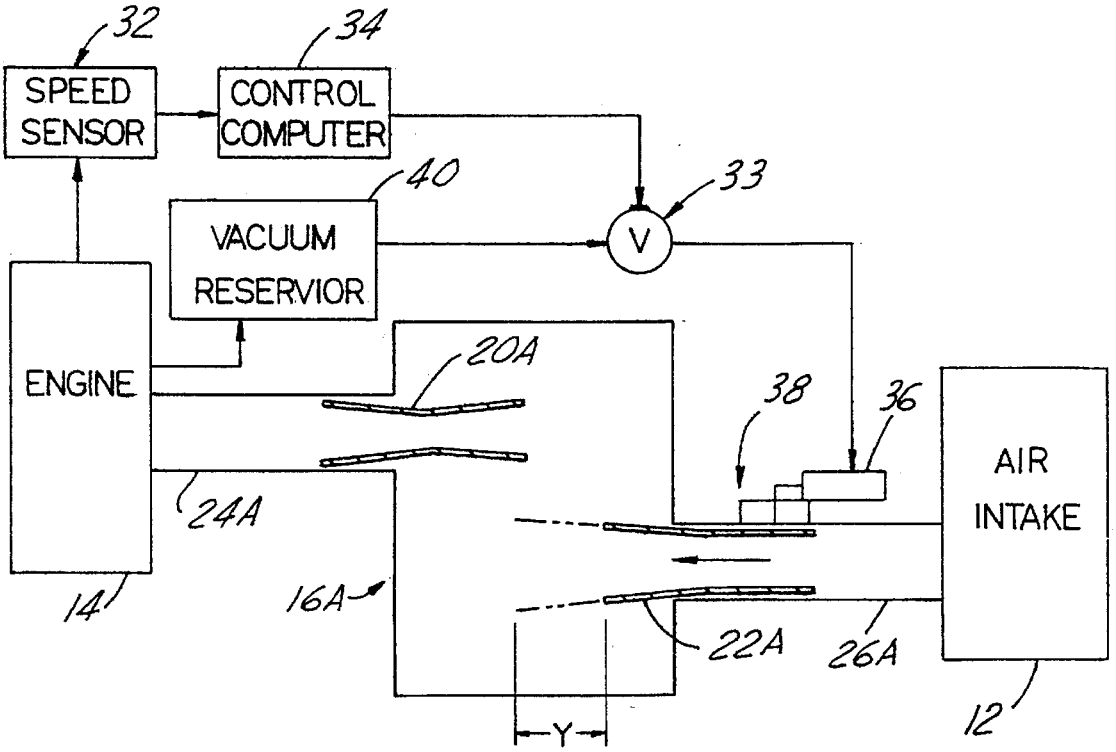
FIG. 2 is a diagrammatic representation of a noise attenuation device according to a second embodiment of the invention.

FIG. 2 shows an alternative embodiment in which the resonator inlet 20A and outlet 22A, while oppositely directed, are not aligned, but are offset on opposite sides of the resonator housing 16A. The tuning tube 22A is axially movable through a range "Y" by a vacuum actuator 36 and linkage 38. The vacuum actuator 36 may receive engine vacuum from a vacuum reservoir 40 connected to the outlet 24A and to the engine 14 to develop a vacuum. Speed sensor 32 and control computer 34 activate a solenoid valve 33 when an adjustment is called for, allowing vacuum to be applied to actuator 36.

Again, the adjustment could be carried out incrementally.

Figure 3:
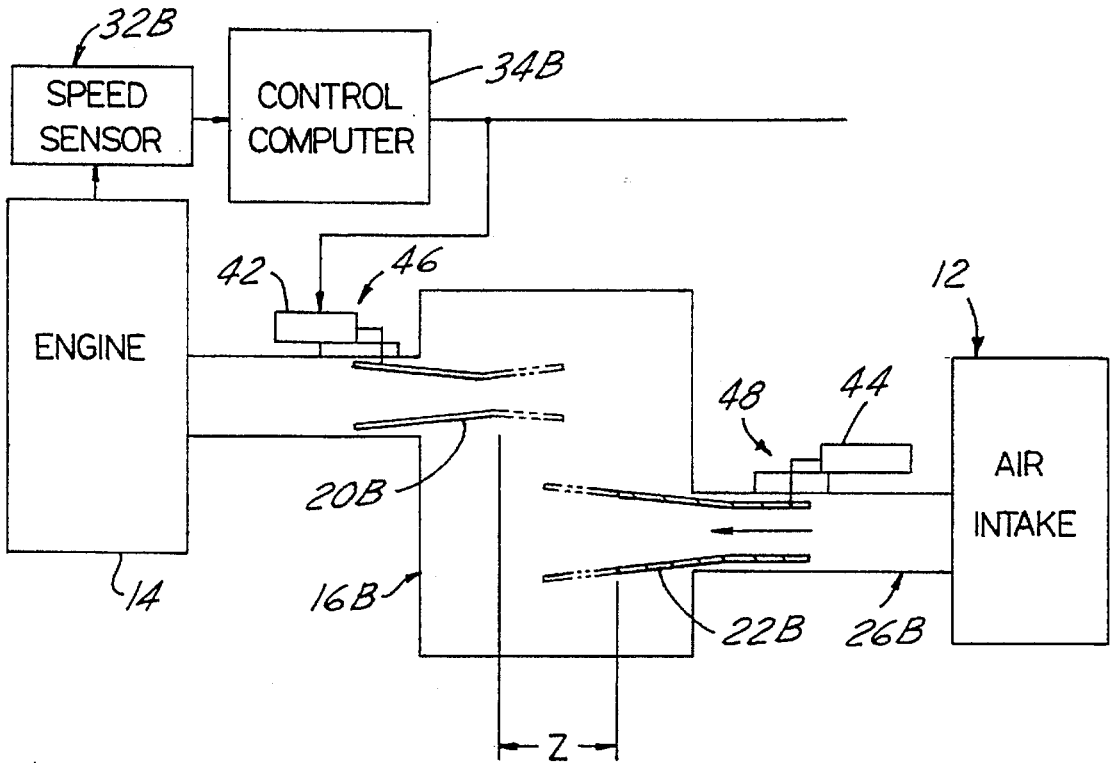
FIG. 3 is a diagrammatic representation of a noise attenuation device according to a third embodiment of the invention.

FIG. 3 shows another arrangement where both opposing tuning tubes 20B, 22B are driven axially with respective stepper motors 42, 44 and linkages 46,48. The engine speed sensor 32B and control computer 34B enable both tubes 20B, 22B to be axially driven over a combined range "Z" between an underlapped and overlapped condition of tuning tubes 20B, 22B.

Figure 4:
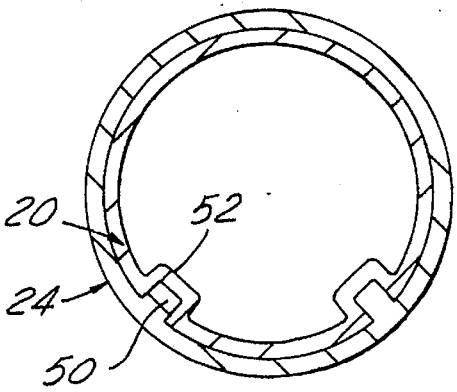
FIG. 4 is a transverse sectional view through a tuning tube and a tube receiving portion of the resonator housing showing the axially movable mounting of the tube tube used in the device according to the invention.

FIG. 4 shows a possible mounting of the movable tuning tube 20 in the outlet 24 in which a protruding axial rail 50 in the interior of outlet 24 is received in a molded groove 52 in the outside of the tuning tube 20. Thus, guided axial movement of the tuning tube 20 is assured when they are being driven between the underlapped and overlapped conditions.

We claim:

1. A selectively tunable air induction system for an internal combustion engine comprising:

an air flow path having an air inlet via which induction air enters the system and an air outlet via which air passes to the engine, said air flow path further comprising a walled chamber defining an expansion chamber space, which space is disposed between said air inlet and said air outlet;

a tuning tube which forms a portion of said air flow path and through which induction air flow that has entered said air inlet passes independent of engine speed;

and an actuator for selectively positioning said tuning tube relative to said chamber space over a tuning range comprising means for bodily axially positioning said tuning tube relative to said cheer space, wherein said tuning tube comprises opposite axial ends, one of which is disposed within said chamber space and the other of which is disposed without said chamber space over such tuning range.

2. A selectively tunable air induction system as set forth in claim 1 further including a further tuning tube which forms another portion of said air flow path and through which induction air flow that has entered said air inlet passes, wherein said further tuning tube comprises opposite axial ends, one of which is disposed within said chamber space and the other of which is disposed without said chamber space.

3. A selectively tunable air induction system as set forth in claim 2 wherein said tuning tubes are disposed in axial alignment.

4. A selectively tunable air induction system as set forth in claim 3 wherein said actuator and said tuning tubes are constructed and arranged such that said axial ends of said tuning tubes that are disposed within said chamber space are selectively relatively positionable to axially underlapped and axially overlapped conditions.

5. A selectively tunable air induction system as set forth in claim 2 wherein said tuning tubes are disposed in non-axial alignment.

6. A selectively tunable air induction system as set forth in claim 5 wherein said tuning tubes are disposed mutually parallel, and wherein said actuator and said tuning tubes are constructed and arranged such that said axial ends of said tuning tubes that are disposed within said chamber space are selectively relatively positionable to mutually parallel axially underlapped and axially overlapped conditions.

7. A selectively tunable air induction system as set forth in claim 6 including a further actuator for selectively positioning said further tuning tube relative to said chamber space comprising means for bodily axially positioning said further tuning tube relative to said chamber space.

8. A selectively tunable air induction system as set forth in claim 1 wherein the location of said other axial end of said tuning tube in said air flow path is downstream of said chamber space.

9. A selectively tunable air induction system as set forth in claim 1 wherein the location of said other axial end of said tuning tube in said air flow path is upstream of said chamber space.

10. A selectively tunable air induction system as set forth in claim 1 further including a guidance tube extending from said walled chamber and providing guidance of said tuning tube as said tuning tube is bodily axially positioned relative to said chamber space by said actuator, wherein the other axial end of said tuning tube is always disposed within said guidance tube over such tuning range.

11. A selectively tunable air induction system for an internal combustion engine comprising:

an air flow path having an air inlet via which induction air enters the system and an air outlet via which air passes to the engine, said air flow path further comprising a walled chamber defining an expansion chamber space, which space is disposed between said air inlet and said air outlet;

a first tuning tube which forms a first portion of said air flow path and through which induction air flow that has entered said air inlet passes independent of engine speed;

a second tuning tube which forms a second portion of said air flow path and through which induction air flow that has entered said air inlet passes independent of engine speed;

and actuator means for selectively positioning said tuning tubes relative to said chamber space over a tuning range comprising means for bodily axially positioning each tuning tube relative to said chamber space, wherein each tuning tube comprises opposite axial ends, one of which is disposed within said chamber space and the other of which is always disposed without said chamber space over such tuning range.

12. A selectively tunable air induction system as set forth in claim 2 wherein said tuning tubes are disposed in axial alignment.

13. A selectively tunable air induction system as set forth in claim 12 wherein said actuator means and said tuning tubes are constructed and arranged such that said axial ends of said tuning tubes that are disposed within said chamber space are selectively relatively positionable to axially underlapped and axially overlapped conditions.

14. A selectively tunable air induction system as set forth in claim 11 wherein said tuning tubes are disposed in non-axial alignment.

15. A selectively tunable air induction system as set forth in claim 14 wherein said tuning tubes are disposed mutually parallel, and wherein said actuator means and said tuning tubes are constructed and arranged such that said axial ends of said tuning tubes that are disposed within said chamber space are selectively relatively positionable to mutually parallel axially underlapped and axially overlapped conditions.

16. A method for selectively tuning an air induction system of an internal combustion engine comprising:

providing an air flow path having an air inlet via which induction air enters the system and an air outlet via which air passes to the engine, and further providing said air flow path with a walled chamber defining an expansion chamber space, which space is disposed between said air inlet and said air outlet;

providing a tuning tube which comprises opposite axial ends, which forms a portion of said air flow path, and through which induction air flow that has entered said air inlet passes independent of engine speed;

disposing said tuning tube such that one of said tuning tube's opposite axial ends is disposed within said chamber space and the other is disposed without said chamber space;

and selectively positioning said tuning tube relative to said chamber space over a tuning range by bodily axially positioning said tuning tube relative to said chamber space over such tuning range, wherein said one of said tuning tube's opposite axial ends continues to be disposed within said chamber space and the other without said chamber space as said tuning tube is bodily axially positioned over such tuning range.

17. A method for selectively tuning an air induction system of an internal combustion engine as set forth in claim 16 further comprising:

providing a further tuning tube which comprises opposite axial ends, which forms another portion of said air flow path, and through which induction air flow that has entered said air inlet passes;

disposing said further tuning tube such that one of said further tuning tube's opposite axial ends is disposed within said chamber space and the other is disposed without said chamber space; and selectively relatively positioning said tuning tubes within said chamber space to cause said one ends of said tuning tubes to relatively axially overlap and relatively axially underlap each other.

18. A method for selectively tuning an air induction system of an internal combustion engine as set forth in claim 17 wherein said step of selectively relatively positioning said tuning tubes within said chamber space to cause said one ends of said tuning tubes to relatively axially overlap and relatively axially underlap each other comprises:

positioning said one ends of said tuning tubes to relatively axially overlap at a first engine speed, and positioning said one ends of said tuning tubes to relatively axially underlap at a second engine speed, said second engine speed being greater than said first engine speed.

19. A method for selectively tuning an air induction system of an internal combustion engine as set forth in claim 17 wherein the steps of disposing said tuning tubes further comprises:

disposing said tuning tubes in axial alignment with each other.

* * * * *